United States Patent [19]

Abendroth

[11] 4,412,891

[45] Nov. 1, 1983

[54] COKE OVEN DOOR HAVING PROFILED SEALING DIAPHRAGM

[75] Inventor: Werner Abendroth, Haltern, Fed. Rep. of Germany

[73] Assignee: Firma Carl Still GmbH & Co. KG, Fed. Rep. of Germany

[21] Appl. No.: 405,584

[22] Filed: Aug. 5, 1982

[30] Foreign Application Priority Data

Aug. 6, 1981 [DE] Fed. Rep. of Germany ..... 3131157

[51] Int. Cl.[3] ..... C10B 25/06; C10B 25/16

[52] U.S. Cl. ..... 202/248; 202/269

[58] Field of Search ..... 202/248, 269; 110/173 R; 49/481, 485

[56] References Cited

U.S. PATENT DOCUMENTS

| | | | |
|---|---|---|---|
| 3,876,506 | 4/1975 | Dix et al. | 202/248 |
| 3,933,598 | 1/1976 | Pries | 202/248 |
| 4,028,193 | 6/1977 | Nagayoshi | 202/248 |
| 4,189,352 | 2/1980 | Stanke | 202/248 |
| 4,290,372 | 9/1981 | Sato | 202/248 |
| 4,295,938 | 10/1981 | Haaf | 202/248 |
| 4,336,108 | 6/1982 | Dix | 202/248 |
| 4,337,122 | 6/1982 | Kurihara | 202/248 |

FOREIGN PATENT DOCUMENTS

| | | | |
|---|---|---|---|
| 23273 | 2/1981 | European Pat. Off. | 202/248 |
| 819087 | 7/1949 | Fed. Rep. of Germany | 202/248 |
| 2157915 | 5/1973 | Fed. Rep. of Germany | 202/248 |
| 701570 | 12/1953 | United Kingdom | 202/248 |

*Primary Examiner*—Bradley Garris

*Attorney, Agent, or Firm*—McGlew and Tuttle

[57] ABSTRACT

A coke oven door assembly which is engageable in coke oven frame comprises a door body with a sealing diaphragm which has a clamp leg portion which extends substantially parallel to a surface of the door and a free leg portion which extends substantially at right angles to the clamped leg portion. An adjusting element overlies the clamped leg portion and is clamped in position by a clamp assembly which carries a fixed bar in a movable part which bears against the free leg portion and is biased by a spring into engagement with the free leg portion. The free leg portion is adapted to have a knife edge portion at the end thereof engaged against the door frame and any displacement of the door relative to the door frame will be indicated by a change in position of the movable part carried by the clamp.

11 Claims, 4 Drawing Figures

COKE OVEN DOOR HAVING PROFILED SEALING DIAPHRAGM

FIELD AND BACKGROUND OF THE INVENTION

The invention relates in general to coke ovens and in particular to a new and useful coke oven door with a circumferential packing strip designed as a profiled sealing diaphragm, which bears tightly with one leg on the door body and is held for linear displacement in the direction of the oven axis, and whose free leg is influenced by spring elements which are arranged between the free leg and an abutment and which is pushed toward the door frame.

In horizontal chamber-coke ovens, correspondingly high coke oven doors are placed in front of the narrow sides and pressed tightly on the door frame by spring elements in order to seal the entire coke oven from the atmosphere. Since the coke oven doors must be removed every time the contents of the coke oven is compressed and inserted again, the packing strips pressed on the door frame are subject to great stress. Numerous suggestions have therefore been made for the design of the packing strips themselves and of the spring elements and adjusting means influencing them. The stress on the packing strips is moveover increased considerably by the fact that the coke oven door becomes bent by heat after its installation, and this must be compensated by the packing strip. Particularly in the case of flat packing strips, the packing strip itself is subject to deformations in the range of the free part, which compensates a part of the spring force, so that here too a corresponding adaptation and adjustment is necessary. Packing strips are known (U.S. Pat. No. 3,933,598) which are designed as angle- or z-profiled sealing diaphragms. The springs, or the spring housing, influencing the free leg of the packing strip are mounted displaceably on the coke oven door. They can only be adjusted by loosening screws. Beyond that, they require supports which are secured on the door body, that is, they must be cast-on as a rule. These supports are necessary to fix the spring housing in its position against restoring forces. If the spring housings are not set exactly to the bending line of the coke oven door, the spring forces are no longer identical. The pressures of the sealing edge against the oven frame will vary in size in certain partial regions. The setting of these sealing systems is extremely complicated, particularly when the coke oven door is twisted additionally apart from the thermal sag. It was found that the known measures for setting the spring-loaded sealing edge lead particularly in high ovens to very complicated and expensive doors. Specially trained men must be used for the green assembly and for the continued maintenance, which represents a considerable burden in respect to personnel, particularly at the present time.

SUMMARY OF THE INVENTION

The object of the invention is to provide a packing strip with great restoring forces which are effective even at small lengths projecting over the door body, as well as a setting which is also effective separately regarding the free and the clamped leg.

According to the invention the packing strip comprises a thin walled double diaphragm whose free leg is influenced by adjustable spring elements arranged in a protective tube, the spring elements bearing on the clamping element serving as an abutment for the adjusting element holding the other leg.

The packing strip itself has an advantageous form which permits sufficient bending, even under limited space conditions, without leading to deformations of the packing strip. In this double z-profiled diaphragm the free leg is partly doubled so that it always has a certain freedom of movement, which is increased by the fact that additional movement possibilities are provided on the connecting arc of both parallel guided parts of the free leg. This profiled diaphragm is held and influenced with advantage by a combination spring element and clamping element which permits separate adjustment of the adjusting element and thus of the clamped leg of the packing strip and of the spring elements influencing the free leg of the packing strip.

According to an advantageous embodiment, the free leg of the packing strip extends in a loop in the direction of the door stopper and then in opposite direction. The space available even in existing ovens is utilized with advantage to ensure a sufficiently long free leg for the packing strip. As mentioned above, it is of advantage that the border connecting the two parallel parts of the free leg contributes to an additional advantageous resilience of the entire system.

Particularly with adjusting elements secured tightly on the door body, it is advisable to secure a T-section bar whose web end rests on the door frame to the tip of the free leg. This improves the transmission of the spring forces to the sealing edge striking the door frame directly. A particularly good connection between the free leg and the T-section bar is obtained when the free leg is secured substantially centrally on the vertical part of the T-section bar. As a rule a connection or fastening is preferred which is displaced from the center in the direction of the flange of the T-section bar.

In a very expedient embodiment, a self-locking disc serves as a clamping element, where the adjusting element designed as a strip and the clamped leg of the packing strip are adjustable over the cam and where the shaft extended beyond the disc is designed as an abutment for the spring elements. In such profiled sealing diaphragm, the diphragm itself can be adjusted according to the contours of the sealing surface of the frame, independent of the thermal deformation of the door body, and be connected gas-tight with the door body by the adjusting element designed as a strip. The fine adjustment is then effected over the influence of the spring elements, which again bear on the same shaft which also carries the disc and the cam. Both elements can thus be adjusted independent of each other, which is particularly important for a gas-tight oven door, because the full locking forces can act here on the packing strip.

In order to facilitate the assembly and to obtain a favorable support for the spring elements, a sleeve is pushed over the extended shaft, which carries a hub screw with checking nut influencing the spring elements and extending into the protective tube. This fine adjustment, or, depending on the procedure, the preceding adjustment of the spring elements can be effected over the hub screw with checking nut to restore a tight fit of the profiled diaphragm on the surface of the door frame in thermal deformations.

A reliable guidance of the spring elements and a large surfaced fastening of the spring elements on the free leg of the packing strip is achieved according to the invention in this way that the spring elements rest on the bottom of the protective tube and are guided by a tube with a disc guiding the hub screw. The spring element or spring elements are clamped between the bottom of the housing and the disc to be influenced over the adjusting nut. The tube also serves as a guide for the spring elements composed of individual parts and for the disc, that is the tube prevents canting of the disc even under an unfavorable influence.

The above described part can also comprise a double part in order to permit good adaptation to the given conditions particularly in subsequent installations, to which end the sleeve is designed as part of a rocker which carries at one end a hub screw with adjusting nut.

According to another advantageous embodiment, a clamping screw serves as a clamping element which holds the adjustment element in the form of an angle strip and which can be displaced relative to the clamping screw, its arm pointing away from the door body carrying in turn the protective tube for the adjustable spring elements. Such an embodiment is particularly suitable for the modification of existing coke oven doors where the clamping screw also has with advantage at the same time lugs or surfaces over which an adjustment is simplified by hammer blows. Such a combination clamping and adjusting device permits thus the adjustment of the diaphragm according to the contours of the oven frame and door body regarding the thermal deformation after disconnecting the clamping connection proper between door body and double z-profiled sealing diaphragm. In this adjustment, the pre-stressed compression spring plungers are also adjusted and indicate a visible distance between the counter nut and the slot bolt of each pressure plunger after proper pressure distribution toward the oven frame surfaces. This adjustment can be effected with advantage in steps, since the adjusting element is connected in a variable distance with the clamping screw over an adjusting screw.

Another correction of the adjustment of pressing forces on the sealing edge is possible according to the invention in that the spring elements, and thus the compression spring plungers influencing the free leg can be adjusted by a slot bolt screwed into the protective tube. Such a slot bolt is preferably readily accessible, so that such fine corrections can actually be made. Beyond that, the slot bolt can also be easily screwed out, so that the plungers and the springs can be easily disassembled and replaced by new ones in maintenance and repair operations.

In an advantageous combination of clamping and adjusting elements, as well as of the spring elements, a combined single or group housing construction is possible where two clamping screws each and two or three protective tubes with spring elements and compression spring plungers form such a combination clamping and adjusting unit.

The invention is particularly characterized in that a highly effective and easy adjustment of the oven door seal is provided whose parts can be adjusted separately or jointly and whose effectiveness is further increased by the special design of the packing strip as a thin-walled double z-profiled diaphragm. Such a device can readily be operated even by unskilled workers, and a tight seal of the oven chamber from the atmosphere is always ensured even during the adjustment.

Accordingly, it is an object of the invention to provide a coke oven door assembly which is engageable in a coke oven frame in which a packing strip is disposed between the door and the frame and includes a clamp leg portion which is clamped to the door and an adjustable element in between and a free leg portion which extends substantially at right angles to the clamp leg portion which has an edge which may be downturned or carry a T-bar which is engaged against the door frame which also includes a spring biased element which is mounted on the clamp which is engaged against the free leg portion and is movable thereby and indicates the change in the position of the frame and the door.

A further object of the invention is to provide a coke oven door construction which is simple in design, rugged in construction and economical to manufacture.

The various features of novelty which characterize the invention are pointed out with particularly in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
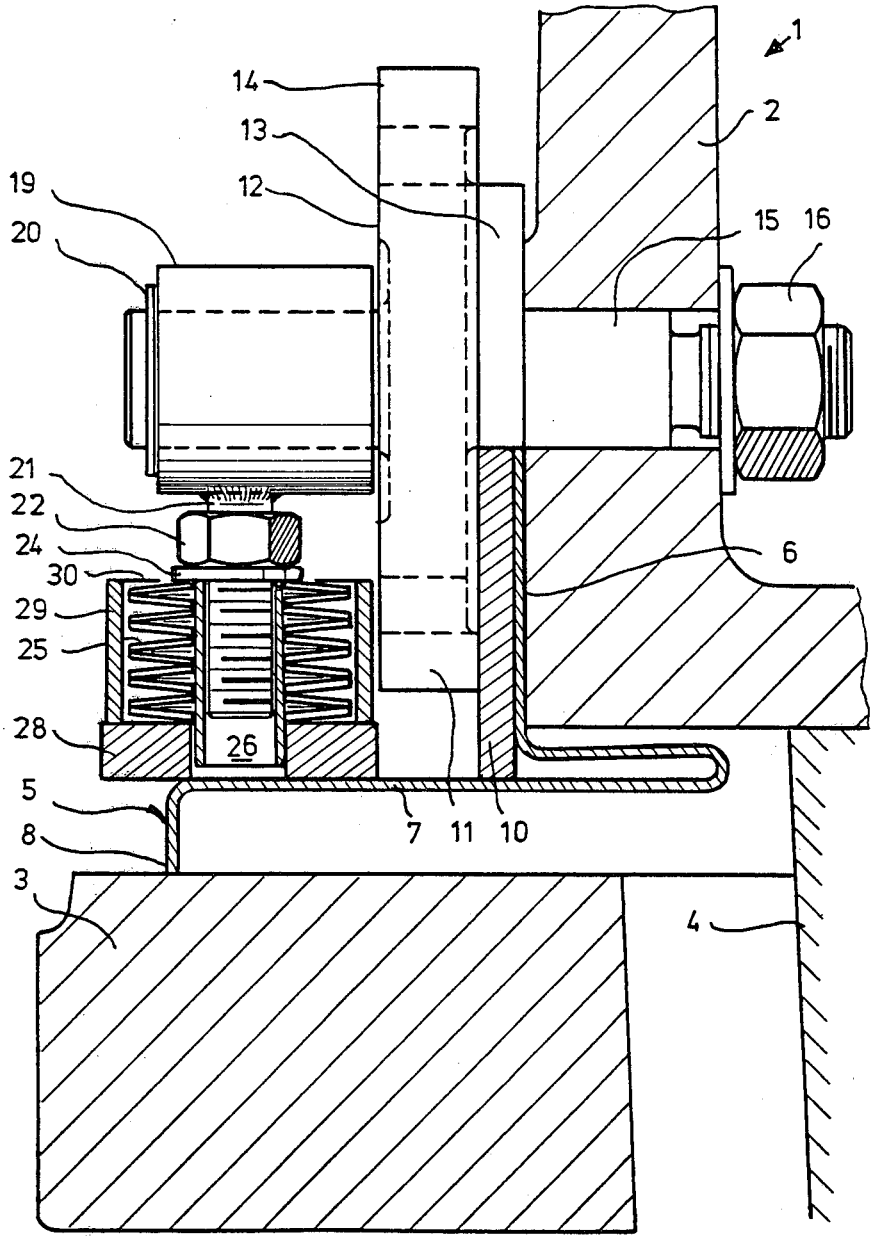
FIG. 1 is a partial cross sectional view of a coke oven door indicating the sealing thereof with the door frame in accordance with the invention.

Referring to the drawings in particular the invention embodied therein comprises a coke oven door assembly generally designated 1 which is engageable in a coke oven frame 3 which includes a door body 2 having a sealing diaphragm or packing strip generally designated 5 for sealing the door body in the door frame. Sealing diaphragm 5 has a clamp leg portion 6 disposed over a portion of the door body and a free leg portion 7 which extends substantially at right angles to the clamp leg portion and has an end portion 8 which is adapted to bear in sealing engagement with frame 3. An adjusting element 10 is positioned to overlie at least a portion of the clamp leg portion and a clamp assembly is mounted on the door frame and clamps the element 10 over the clamp leg portion 6. Spring indicating means are carried by the clamp assembly and include a fixed part in the form of a hub screw 21 and a movable part in the form of an engagement bottom of a protective tube 29 which engages over the free leg 7. The movable part or bottom 28 is biased to engage the free leg 7 by spring elements 25 which may permit displacement of spring elements so that a side edge 30 may move up over a collar portion 24 which is arranged below an adjusting nut 22 on the hub 21.

FIG. 1 shows the edge zone of a coke oven door 1 with a packing strip 5 secured on door body 2 and pressed on door frame 3. The packing strip is designed as a double z-profiled diaphragm, where the region of the free leg 7 adjoining the clamped leg 6 is partly doubled, that is, formed by parts extending parallel to each other. The free leg 7 is adjoined by the knife edge 8 which bears tightly on door frame 3. The double region of packing strip 5 extends in the direction of door stopper 4, that is, into a space generally available for this purpose even in existing coke ovens.

The upright strip 10, which can be continuous or divided into sections, is pressed together with clamped leg 6 of the sealing strip 5 by clamping element 11 against door body 2. A clamping element comprises a disc 14 of a cam disc 12. Cam 13 of cam disc 12 influences adjusting element 10 and clamped leg 6 simultaneously in the direction of the oven axis when disc 14 is turned.

Cam disc 12 is secured on door body 2 on a shaft 15 having a retaining nut 16. Shaft 15 can be extended beyond disc 14 and carries a sleeve 19.

Sleeve 19 is secured on shaft 15 by a snap ring 20. Sleeve 19 carries a hub screw 21 with adjusting nut 22. Hub screw 21 extends into tube 26 guiding spring elements 25 and permits bracing of spring elements 25 by the adjusting nut 22 against the bottom 28 of protective tube 29. Adjusting nut 22 presses disc 24 on spring elements 25. Bottom 28 in turn influences the end region of free leg 7 of packing strip 5. At the upper end of protective tube 29 is provided a sight edge 30 over which it can be easily determined whether an adjustment is necessary, which must be done, e.g. when disc 24 disappears inside protective tube 29.

Figure 2:
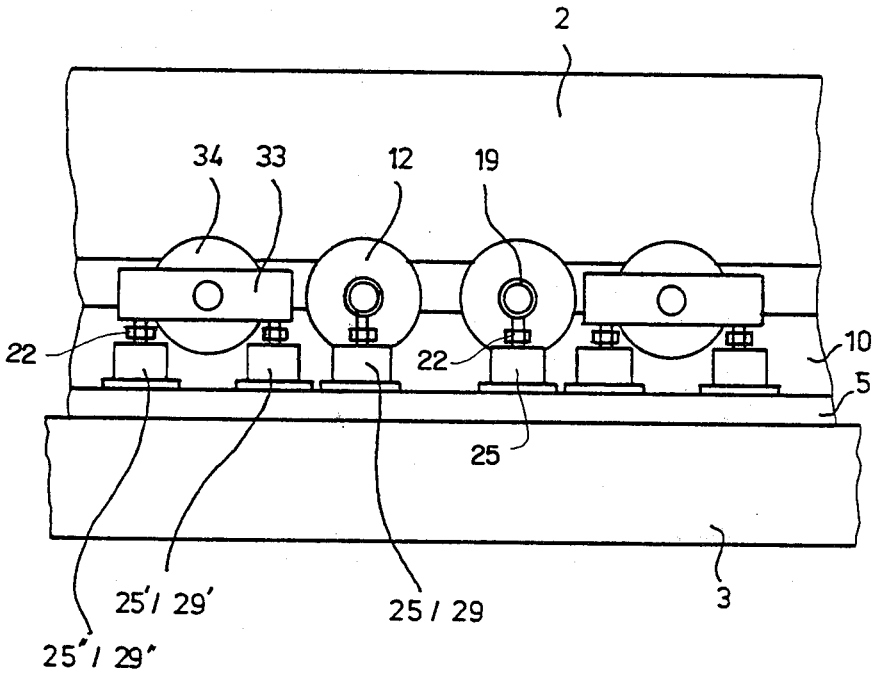
FIG. 2 is a partial side elevational view of the coke oven door assembly shown in FIG. 1.

FIG. 2 shows a possibility of designing the above-described adjusting means as a single or multipart element. To this end sleeve 19 is part of a rocker 33 which carries at its end respectively spring elements and protective tubes 25'/29', and 25''/29''. The double part has then only one cam disc 34.

Figure 3:
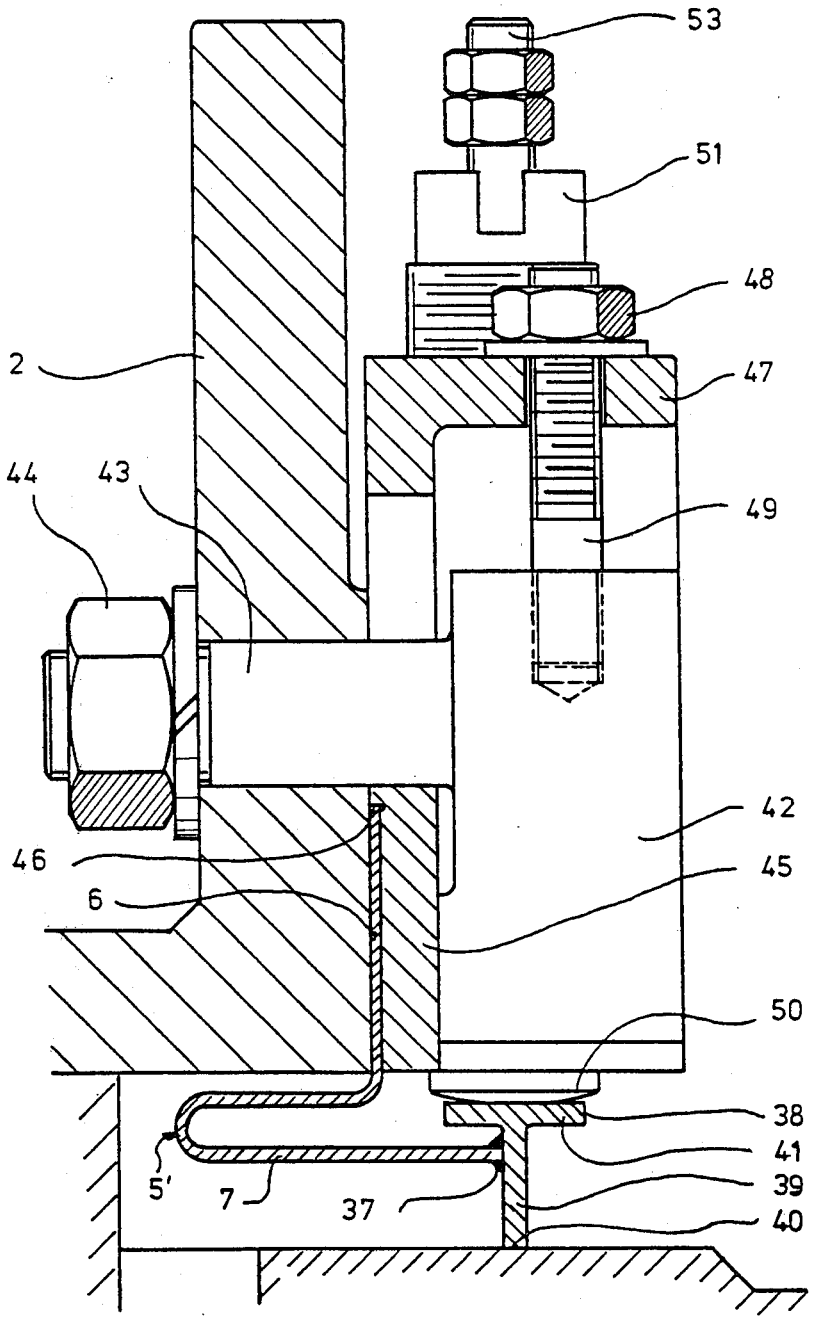
FIG. 3 is a sectional view similar to FIG. 1 of another embodiment of the invention.
Figure 4:
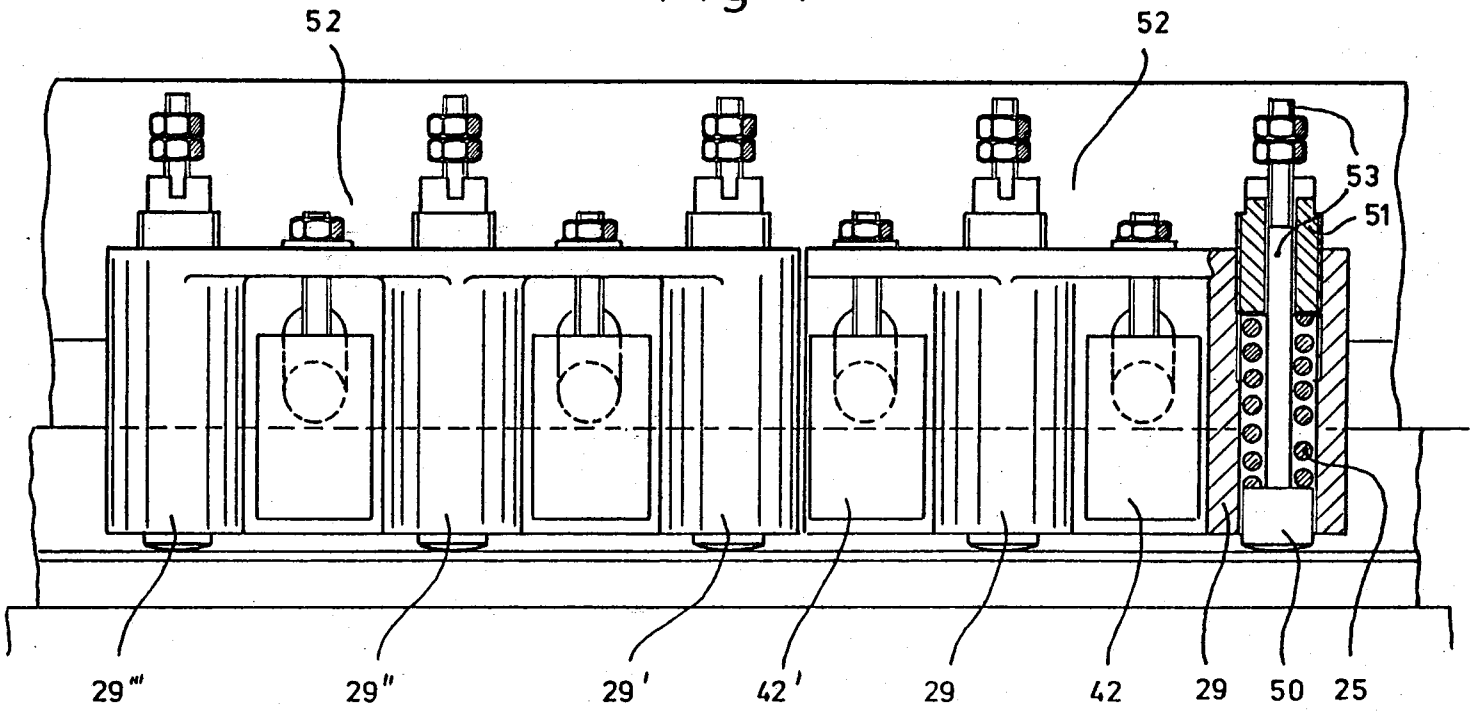
FIG. 4 is a side elevational view of the construction shown in FIG. 3.

FIGS. 3 and 4 show a combined clamping and adjusting device as a single- or group housing design, adapted to the existing bores in the coke oven doors. Each combination housing consists of one or two clamping screws 42, combined with adjusting screw 49, as well as two or three or more adjustably pre-stressed compression spring plungers 50 which are adapted to the door locks. The combination clamping and adjusting device permits adjustment of the diaphragm according to the contours of door frames 3 and door body 2 with respect to the thermal deformation, after easy disconnection of the clamping connection proper between door body and double z-profiled diaphragm. In this adjustment the prestressed compression spring plungers 50 are also adjusted and indicate, after proper pressure distribution of packing strip 5 toward door frame 3, a visible distance between the counter nut and slot bolt 51 of each compression spring plunger 50. Due to the common adjustment of the double z-diaphragm with protective tube 29, and the pre-stressed compression spring plungers 50, the practical adjustment of the oven door packing can be effected by anybody. Likewise, a coarse adjustment of the double z-diaphragm by a hammer blow on the housing proper can be practiced, which makes a disconnection of the clamping connections unnecessary. A further correction of the adjustment of the pressures on knife edge can be made over the readily accessible adjustable slot bolt 51. This has the effect that the sum of the two locking forces actually acts on packing strip 5 and is not reduced by the thermal deformations of the door body.

Due to the offset housing flange surface, the double z-diaphragm of thin metal sheet is uniformly adjusted without a concentrated load, and thus prevents thermal deformations of any kind without an additional pressure strip. The lateral clamping surface remains always constant after the adjustment.

Leg 6 of packing strip 5' shown in FIG. 3 is pressed against door body 2 by the clamping screw 42 together with adjusting element 45 designed as an angle section. For the adjustment in the direction of the oven axis, leg 6 is guided in a recess 46 of adjusting element 45. On the top 37 of packing strip 5 is secured a T-section bar 38, namely in the range of the vertical part 39. The end 40 is pressed tightly on the oven frame or door frame 3, since flange 41 ensure a favorable introduction of the forces of compression spring plunger 50 influenced over spring elements 25 (FIG. 4).

Clamping screw 42 passes with its shank 43 through door body 2 and is clamped by the retaining nut 44. In this way adjusting element 45, designed as an angle section is also fixed by the clamping screw 42, and at the same time is connected with clamping screw 42 through the adjusting screw 49 with adjusting nut 48 in the region of arm 47.

As can be seen from FIG. 4, arm 47 also receives the protective tubes 29, in which spring element 25 is arranged, which is braced between compression spring plunger 50 and slot bolt 51. It can also be seen from FIG. 4 that the various parts form an advantageous combination clamping and adjusting unit 52 where a good observation possibility is provided by plunger rod 53, which ensures simple supervision.

Particularly in the embodiment according to FIG. 3 and 4, protective tube 29 and the spring elements 25 arranged therein have been arranged far from the sealing range proper, so that they are not stressed by the high temperatures of 300° C. in the range of cutting edge 8.

While specific embodiments of the invention have been shown and described in detail to illustrate the application of the principles of the invention, it will be understood that the invention may be embodied otherwise without departing from such principles.

What is claimed is:

1. A coke oven door assembly engageable in a coke oven frame, comprising a door body, a stopper connected to said door body and spaced from an edge of said door body, a sealing diaphragm having a clamp leg portion disposed over a portion of said door body edge and a free leg portion extending substantially at right angles to the clamp leg portion, said free leg portion having an end part adapted to bear in sealing engagement with the frame and substantially parallel to said clamp portion, said sealing diaphragm including a loop formation between said clamp leg portion and said free leg portion having a first part extending toward said stopper from said clamp portion and a second part extending toward said end part to said free leg portion, said first and second parts extending in the space between said door body edge and stopper, an adjusting element overlying at least a portion of said clamp leg portion, a clamp assembly mounted on said door body and clamping said adjusting element over said free leg portion, spring indicating means carried by said clamp assembly including a fixed part and a movable part bearing against said free leg portion, and spring means biasing said movable part into engagement with said free leg portion.

2. A coke oven door assembly according to claim 1, wherein said end part of said free leg portion comprises a knife edge bearing against said door frame.

3. A coke oven door assembly according to claim 1, wherein said end part of said free leg portion comprises a T bar member having a lower edge resting against said door frame.

4. A coke oven door assembly according to claim 3, wherein said free leg portion engages said T bar member on its vertical straight leg portion intermediate the length thereof.

5. A coke oven door assembly according to claim 1, including a self locking cam disc having a cam with a portion thereof defining said adjusting element, said clamp assembly including a shaft on which said disc is rotatable.

6. A coke oven door assembly according to claim 5, including a sleeve engaged over said shaft, a hub screw fixed to said sleeve and comprising said fixed part, said movable part comprising a protective tube having a bottom engagement with said free leg portion.

7. A coke oven door assembly according to claim 6, wherein said spring means comprises spring elements engaged in said movable part and resting on the bottom thereof, said hub screw having a collar engaged thereover, said spring elements engaged between said collar and said bottom of said movable part.

8. a coke oven door assembly according to claim 7, wherein said sleeve includes a rocker carrying said hub screw at one end, said hub screw being threaded and including a checking nut and threadably engaged with said screw above said collar.

9. A coke oven door assembly according to claim 1, wherein said adjusting element comprises an angle member, said clamp assembly including a bolt extending through said angle member and supporting said angle member with a vertical portion overlying said clamp leg portion and a substantially horizontal portion and including a protective tube carried by said horizontal portion for carrying said spring means.

10. A coke oven door assembly according to claim 9, wherein said adjusting element is displaceable said clamp assembly including a clamping screw carrying said adjusting element and including an adjustable nut engaged through said horizontal portion of said adjusting element and threadably engaged with said clamping screw.

11. A coke oven door assembly according to claim 9, including a compression spring plunger comprising said movable part engaged with said free leg portion and an adjustable slot bolt movable in said protective tube.

* * * * *